United States Patent [19]

Vu et al.

[11] Patent Number: 4,890,007

[45] Date of Patent: Dec. 26, 1989

[54] CARPET MAT SWITCH

[76] Inventors: Thuan D. Vu, 323 18 St., Brooklyn, N.Y. 11215; George Spector, 233 Broadway Rm 3815, New York, N.Y. 10007

[21] Appl. No.: 267,241

[22] Filed: Nov. 4, 1988

[51] Int. Cl.[4] ..... G08B 13/10

[52] U.S. Cl. ..... 307/118; 200/86 R; 340/666; 361/178

[58] Field of Search ..... 307/116, 119, 118, 144, 307/139, 140, 326, 328; 361/170, 178; 340/573, 574, 626, 666; 200/50 C, 81 H, 81.4, 82 R, 82 C, 83 C, 83 Z, 331, 85, R, 85 A, 86 R

[56] References Cited

U.S. PATENT DOCUMENTS

| | | | |
|---|---|---|---|
| 2,783,327 | 2/1957 | Luckey | 200/86 R |
| 3,781,843 | 12/1973 | Harrison | 200/81 H |
| 3,916,401 | 10/1975 | Freeman | 340/666 |
| 4,075,616 | 2/1978 | Rait | 340/666 |
| 4,205,236 | 5/1980 | Goof | 307/118 |
| 4,216,469 | 8/1980 | Hirmann | 200/86 R |
| 4,336,533 | 6/1982 | Wattach | 340/666 |
| 4,401,896 | 8/1983 | Fowler | 307/118 |
| 4,449,062 | 5/1984 | Wilson | 307/328 |
| 4,661,664 | 4/1987 | Miller | 200/86 R |

*Primary Examiner*—Gerald P. Tolin

[57] ABSTRACT

A carpet mat switch system is provided in which a person when stepping on a mat structure will electrically activate a lamp, burglar alarm, program talking clock or any other appliance connected thereto. A manual override is also provided to either turn off an actuating unit in the mat structure or manually operate a switch therein without stepping on the mat structure.

4 Claims, 1 Drawing Sheet

42
12
40
38
10
TO POWER SOURCE 18
44
36
14
22
38
24
2
46
2
46
50
44
48
52
16

20
16
62
60
66
42
64
16
34
54
68
56
28
26
30
32

70
56
26
30
26
TO POWER SOURCE 18
28
TO POWER SOURCE 18
56
26
30
22
72
1:00 am
28
58
44
48
49
51
52
30

CARPET MAT SWITCH

BACKGROUND OF THE INVENTION

The instant invention relates generally to actuating devices and more specifically it relates to a carpet mat switch system.

Numerous actuating devices have been provided in prior art that are adapted to turn on electrically operated equipment or the like. For example, U.S. Pat. Nos. 2,783,327; 3,916,401 and 4,661,664 all are illustrative of such prior art. While these units may be suitable for the particular purpose to which they address, they would not be as suitable for the purposes of the present invention as heretofore described.

SUMMARY OF THE INVENTION

A primary object of the present invention is to provide a carpet mat switch system that will overcome the shortcomings of the prior art devices.

Another object is to provide a carpet mat switch system which a person when stepping on a mat structure will electrically activate a lamp, burglar alarm, program talking clock or any other appliance connected thereto.

An additional object is to provide a carpet mat switch system that includes a manual override to either turn off an actuating unit in the mat structure or manually operate a switch therein without stepping on the mat structure.

A further object is to provide a carpet mat switch system that is simple and easy to use.

A still further object is to provide a carpet mat switch system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3:
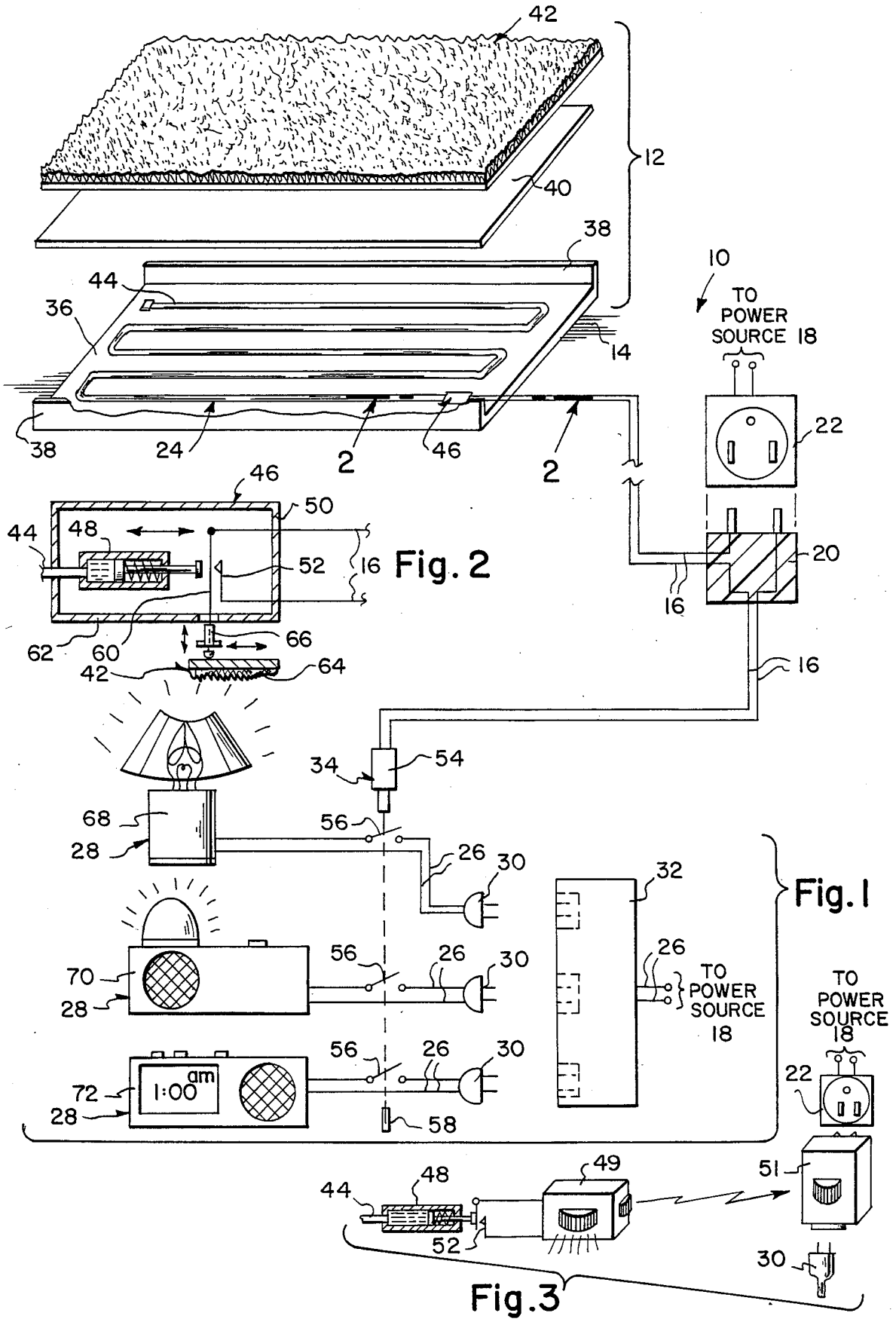
FIG. 1 is a diagrammatic view partly in section and in an exploded perspective showing the electro-mechanical circuitry of the invention.
FIG. 2 is an enlarged cross sectional view taken along line 2—2 in FIG. 1 showing the actuating unit in greater detail.
FIG. 3 is a view partly in perspective of a modification using a battery powered wireless transmitter.

Turning now descriptively to the drawings, in which similar reference characters denote similar elements throughout the several views, FIG. 1 illustrates a carpet mat switch system 10 consisting of a mat structure 12 located on a floor 14. A first electrical circuit 16 is connected between a power source 18 and the mat structure 12 via a main plug 20 and a wall socket outlet 22. A first mechanism 24 is carried in the mat structure 12 for closing the first electrical circuit 16 in response to a person (not shown) standing upon the mat structure 12. A second electrical circuit 26 is connected between the power source 18 and electrical appliances 28 via plugs 30 and socket outlet 32 while a second mechanism 34 is connected to the first electrical circuit 16 for closing the second electrical circuit 26 for activating the electrical appliances 28.

The mat structure 12 includes a base member 36 that has a pair of side walls 38, whereby the base member 36 is placed upon the floor 14. A plate 40 is carried on the base member 36 between the side walls 38, while carpet rug 42 is carried on the plate 40.

The first mechanism 24 includes an elongated sealed fluid filled tube 44 disposed in a zig-zag fashion between the base member 36 and the plate 40 and an actuating unit 46 connected between the tube 44 and the first electrical circuit 16 whereby when the person stands upon the carpet rug 42, the plate 40 will squeeze the tube 44 against the base member 36 causing the actuating unit 46 to close the first electrical circuit 16.

As best seen in FIG. 2, the actuating unit 46 includes a spring biased piston 48 disposed within a housing 50 and fluidly connected to end of the tube 44. An electric switch 52 is connected to the first electrical circuit 16, whereby the electric switch 52 is mechanically operated by the piston 48. A wireless transmitter 49 shown in FIG. 3, can be used instead of wiring to actuate a receiver and main plug 51 so that one of the plugs 30 from any of the electrical appliances 28 can be connected thereto.

The second mechanism 34 includes a solenoid 54 electrically connected to the first electrical circuit 16. On-off switches 56 are connected to the second electrical circuit 26 whereby the on-off switches are mechanically operated by the solenoid 54. A manual override lever 58 is provided and is mechanically connected to the on-off switches 56 to by-pass the solenoid 54.

The actuating unit 46 further includes a manual override lever shaft 60 directly connected to the electric switch 52 which extends through a wall 62 of the housing 50 and covered by an overhang 64 of the carpet rug 42 so that the person can manually operate the electric switch 52 without stepping on the mat structure 12. A sleeve 66 is slideable on the lever shaft 60 so that the person can push the sleeve 66 into the wall 62 of the housing 50 to lock the electric switch 52 and turn off the actuating unit 46.

The electrical appliances 28 as shown in the drawing are each a table lamp 68, a burglar alarm 70 and program talking clock 72. Other electrical appliances 28 can also be used in conjunction with the invention 10 and be actuated when the person steps on the mat structure 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A carpet mat switch system which comprises:

(a) a mat structure located on a floor;

(b) a first electrical circuit connected between a power source and said mat structure;

(c) means carried in said mat structure for closing said first electrical circuit in response to a person standing upon said mat structure;

(d) an electrical appliance;

(e) a second electrical circuit connected between the power source and said electrical appliance;

(f) means connected to said first electrical circuit for closing said second electrical circuit for activating said electrical appliance wherein said mat structure includes;

(g) a base member having a pair of side walls, said base member placed upon the floor;

(h) a plate carried on said base member between said side walls;

(i) a carpet rug carried on said plate wherein said first closing means includes:

(j) an elongated sealed fluid filled tube disposed in a zig-zag fashion between said base member and said plate; and (k) an actuating unit connected between said tube and said first electrical circuit whereby when the person stands upon said carpet rug, said plate will squeeze said tube against the base member causing said actuating unit to close said first electrical circuit; wherein said actuating unit includes:

(l) a housing;

(m) a spring biased piston disposed within said housing and fluidly connected to the end of said tube; and (n) an electric switch connected to said first electrical circuit, said electric switch mechanically operated by said piston, wherein said second closing means includes:

(o) a solenoid electrically connected to said first electrical circuit;

(p) an on-off switch connected to said second electrical circuit, said on-off switch mechanically operated by said solenoid; and (q) a manual override lever mechanically connected to said on-off switch to by-pass said solenoid; wherein said actuating unit further includes:

(r) a manual override lever shaft directly connected to said electric switch which extends through a wall of said housing and is covered by an overhang of said carpet rug so that the person can manually operate said electric switch without stepping on said mat structure; and (s) a sleeve slideable on said lever shaft so that the person can push said sleeve into said wall of said housing to lock said electric switch and turn off said actuating unit.

2. A carpet mat switch system as recited in claim 1, wherein said electrical appliance is a table lamp.

3. A carpet mat switch system as recited in claim 1, wherein said electrical appliance is a burglar alarm.

4. A carpet mat switch system as recited in claim 1, wherein said electrical appliance is a program talking clock.

* * * * *